United States Patent [19]

Liotta

[11] 4,259,172

[45] Mar. 31, 1981

[54] TREATMENT OF HEAVY COAL FRACTIONS

[75] Inventor: Ronald Liotta, Clark, N.J.

[73] Assignee: Exxon Research and Engineering Co., Florham Park, N.J.

[21] Appl. No.: 69,061

[22] Filed: Aug. 23, 1979

Related U.S. Application Data

[63] Continuation-in-part of Ser. No. 969,362, Dec. 14, 1978, abandoned.

[51] Int. Cl.[3] ..... C10G 1/00; C10G 1/06

[52] U.S. Cl. ..... 208/46; 208/8 LE; 208/9; 208/14; 208/22

[58] Field of Search ..... 208/8 LE, 9, 46, 22, 208/14; 201/20; 44/1 R

[56] References Cited

U.S. PATENT DOCUMENTS

| | | | |
|---|---|---|---|
| 2,378,762 | 6/1945 | Frey | 208/46 |
| 3,359,197 | 12/1967 | Masciantonio et al. | 208/14 |
| 3,376,212 | 4/1968 | Masctiatonio et al. | 208/14 |
| 3,992,432 | 11/1976 | Napier et al. | 260/465.1 |
| 4,059,410 | 11/1977 | Schlosberg et al. | 44/1 R |
| 4,072,475 | 2/1978 | Schlosberg et al. | 44/1 R X |
| 4,089,772 | 5/1978 | Gorbaty et al. | 208/8 LE |
| 4,092,235 | 5/1978 | Schlosberg et al. | 208/8 LE |

FOREIGN PATENT DOCUMENTS

| | | |
|---|---|---|
| 851191 | 5/1977 | Belgium . |
| 2634419 | 10/1977 | Fed. Rep. of Germany . |

OTHER PUBLICATIONS

Brandstrom et al. Acta Chem. Scand. 23(1969) No. 6.
Wagenknecht et al. Synthetic Communication 2(4), 45-219 (1972).
A. McKillop et al. Tetrahedon vol. 30, pp. 1379-1382 (1974).
Bashall et al. Tetrahedron Letters No. 40, pp. 3489-3490, (1975).
Dehulow et al. Tetrahedon Letters No. 2, pp. 95-96 (1976).
Blom et al. Fuel 36 135 (1957).
Yohe et al. J.A.C.S. vol. 69, pp. 2644-2648.
Sternberg et al. Fuel 53 172-175 (1974).
Heathcoat et al. J.C.S. 1932, pp. 2839-2843.
Kröger et al. Erdöl und Köhle Erd. Gas Petrochemie, NR5, 18 Jahrg Mail 1965.
Sokolova Chem. AB., vol. 48, p. 3672i (1954).
Fugassi Cool 1962 p. 4946.
Hodek et al. Fuel 1973, vol. 52, Jul., pp. 220-225.
Hodek et al. ACS Div. of Pet. Chem. 22(2), 462 (1977).
Olleman Analytical Chem. vol. 24, No. 9, Sep. 1952.
Nozum DAR et al., Fuel 34, 254-256 (1957).
Nandi et al. J. of Ind. Chem. Soc. Ind. & New Ed. vol. 20, No. 2 (1957).
Nandi et al. Jour. of Indian Chem. Soc. Ind. & News Ed., vol. 20, #3 & 4 (1957).
Roy et al. J. Sci. Indust. Res. vol. 18B, Nov. 1959, pp. 492-493.
Banerjee et al. J. Sci. Ind. Research 19B (1960).
Sen et al. J. Sci. & Ind. Research India 19B (1960).

*Primary Examiner*—Delbert E. Gantz
*Assistant Examiner*—William G. Wright
*Attorney, Agent, or Firm*—D. W. Collins; Henry E. Naylor

[57] ABSTRACT

Increased solubility of heavy fractions of coal (e.g., coal liquefaction bottoms and coal solubilization bottoms) is obtained by oxygen-alkylation or oxygen-acylation of weakly acidic protons such as phenolic and carboxylic functionalities by means of a phase transfer reaction. Phenolic and carboxylic functional substituents, which are very polar, are converted to relatively nonpolar ethers and esters, respectively. The O-alkylation or O-acylation is carried out in a binary liquid phase solution (organic and water phases with a solid phase suspended in the medium). A quaternary ammonium or phosphonium salt is reacted with alkali or alkaline earth base to produce the corresponding quaternary ammonium or phosphonium base (an example of a phase transfer reagent). This quaternary base is non-nucleophilic and readily removes the phenolic and carboxylic protons but does little else to the coal structures. After the removal of the weakly acidic protons by the quaternary base, the phenoxides and carboxylates which are produced then undergo O-alkylation or O-acylation. The alkylating or acylating agent comprises a carbon-bearing functionality and a displaceable leaving group. The O-alkylation or O-acylation reduces hydrogen bonding and polarity, thereby rendering heavy coal fractions more soluble in common organic solvents and petroleum liquids.

22 Claims, No Drawings

TREATMENT OF HEAVY COAL FRACTIONS

CROSS-REFERENCE TO RELATED APPLICATION

This application is a Continuation-in-Part of Ser. No. 969,362, filed Dec. 14, 1978, now abandoned.

BACKGROUND OF THE INVENTION

1. Field of the Invention

This invention is directed to improving the properties of heavy coal fractions and, in particular, to increasing the solubility of heavy coal fractions in common organic solvents and petroleum liquids.

2. Description of the Prior Art

Processes for the liquefaction of coal and similar carbonaceous solids usually involve contacting the feed material with a hydrocarbon solvent and molecular hydrogen at elevated temperature and pressure. This results in partial breakdown of the complex high molecular weight starting material into lower molecular weight hydrocarbon liquids and gases. These are recovered from the liquefaction effluent, leaving a heavy liquefaction bottoms product which normally boils in excess of about 1000° F. and generally contains suspended solid residues. The liquefaction bottoms may constitute 50% or more by weight of the total liquefaction products.

A variety of different processes for upgrading liquefaction bottoms have been proposed in the past. Exemplary of these include pyrolysis of the bottoms that produce gases, additional hydrocarbon liquids and coke, followed by steam gasification of the coke to form hydrogen and carbon monoxide for use as a fuel; see e.g., U.S. Pat. No. 4,060,478. Another process for upgrading liquefaction bottoms is disclosed in U.S. Pat. No. 4,089,772 which discloses an acid-catalyzed C-alkylation or C-acylation of liquefaction product bottoms prior to recycling the bottoms fraction to the liquefaction reaction zone.

These various processes result in more efficacious use of liquefaction bottoms. However, during subsequent coal liquefaction process, phenols present in the coal are cleaved to produce water. In liquefaction processes employing hydrogen, an excessive use of hydrogen thus occurs.

Solvent extraction of coal also leaves behind a high molecular weight, insoluble fraction of coal called coal solubilization bottoms. Like liquefaction bottoms, this heavy fraction is also the object of various upgrading processes in order to obtain increased liquid yields.

SUMMARY OF THE INVENTION

In accordance with the present invention, functionalities having weakly acidic protons in heavy coal fractions are treated by a process selected from the group consisting of alkylation and acylation (sometimes referred to herein as oxygen or O-alkylation and oxygen or O-acylation). Weakly acidic protons include phenolic, carboxylic and mercaptan functionalities. The O-alkylation or O-acylation is conveniently carried out by use of a phase transfer reagent and an alkylating or acylating agent. The phase transfer reagent, which is recyclable, is by way of example a quaternary ammonium or phosphonium base ($R_4QOR''$), where each R is the same or different group selected from the group consisting of $C_1$ to about $C_{20}$ alkyl and $C_6$ to about $C_{20}$ aryl; Q is nitrogen or phosphorus; and R'' is selected from the group consisting of hydrogen, $C_1$ to about $C_{10}$ alkyl, aryl, alkylaryl, aryl-alkyl and acetyl. The alkylating and acylating agents are represented by the formula R'X where R' is a $C_1$ to $C_{20}$ alkyl or acyl group and X is a leaving group selected from the group consisting of halide, sulfate, bisulfate, acetate and stearate, wherein X is attached to a primary or secondary carbon atom.

O-alkylated or O-acylated heavy coal fractions evidence increased solubility in common organic solvent and are more compatible with petroleum liquids than those not so treated.

DETAILED DESCRIPTION OF THE INVENTION

Heavy coal fractions are those residues derived from coal by a variety of processes including hydrogenation and donor solvent reactions involving a distillation to remove coal liquids. Coal liquefaction bottoms, though only a by-product of the liquefaction process, constitute an undesirably large fraction of the total liquefaction products. Exemplary of the solvent hydrogen donor liquefaction process is that described in U.S. Pat. No. 3,617,513.

Coal solubilization bottoms are those residues derived from coal by a variety of solvent extraction processes. Exemplary of the solvent extraction process is that described in U.S. Pat. No. 3,607,716, which discloses supercritical gas extraction.

The alkylation or acylation process disclosed herein may be advantageously employed with any heavy coal fractions, regardless of derivation. As used herein, the terms "coal bottoms" and "heavy fractions" are synonymous and relate to coal residues derived by coal treatment processes such as liquefaction, solubilization and the like. Certain gasification processes yield a by-product tar, which is also a coal residue contemplated for treatment by the process of the invention.

By the process of the invention, functionalities containing weakly acidic protons in the treated material are chemically altered. For example, acidic proton-containing groups such as phenolic and carboxylic, which are very polar frunctional groups are converted to relatively non-polar ethers and esters, respectively. The chemical transformation may be represented as follows:

$$Ar—OH + R'X \rightarrow Ar—OR'$$

$$Ar—COOH + R'X \rightarrow Ar—COOR'$$

where R' is a $C_1$ to about $C_{20}$ alkyl or acyl group.

The O-alkylation or O-acylation of coal bottoms by reagents which are in liquid solution is greatly influenced by the use of a phase transfer reagent. Such a reagent has both a lipophilic and a hydrophilic portion and is capable of transferring a basic species, —OR'', from an aqueous phase to either a solid or liquid organic phase, where R'' is either hydrogen or a carbon-bearing functionality. The phase transfer reagent may be generated catalytically, in which case the process is termed a phase transfer catalysis, which is a well-known reaction; see, e.g. Vol. 99, *Journal of the American Chemical Society*, pp. 3903–3909 (1977). Alternatively, the reagent may be generated in a separate step, then used in the alkylation or acylation reaction. If this latter reaction is employed, then the active form of the reagent may be regenerated in a subsequent step. In either case, the overall chemical transformation on the coal bottoms is the same. A generalized mechanistic scheme for this transformation is shown below:

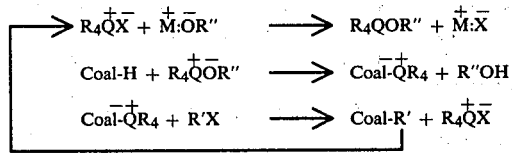

The phase transfer reagent is preferably a quaternary base represented by the formula $R_4QOR''$ where each R is the same or different group selected from the group consisting of $C_1$ to about $C_{20}$, preferably $C_1$ to $C_6$ alkyl and $C_6$ to about $C_{20}$, preferably $C_6$ to $C_{12}$ aryl group; Q is nitrogen or phosphorus, preferably nitrogen; and R" is selected from the group consisting of hydrogen, $C_1$ to about $C_{10}$, preferably $C_1$ to $C_6$ alkyl, aryl, alkylaryl, arylalkyl and acetyl group; more preferably a $C_1$ to $C_4$ alkyl group and most preferably hydrogen. The phase transfer reagent may be generated by reacting the corresponding quaternary salt $R_4OX$ with a metal base MOR" where X is selected from the group consisting of halide, sulfate, bisulfate, acetate and stearate. Preferred is when X is a halide and selected from the group consisting of chlorine, bromine and iodine, more preferably chlorine. M is selected from the group consisting of alkali metals, more preferably sodium and potassium. As shown above, the quaternary base is then reacted with the acidic groups on the coal which in turn is reacted with at least one alkylating or acylating agent represented by the formula R'X wherein R' is selected from the group consisting of $C_1$ to about $C_{20}$ alkyl or acyl group and X is as previously defined, as long as X is attached to a primary or secondary carbon atom. Preferably R' is an inert hydrocarbon—that is, a hydrocarbon group containing only hydrogen and carbon, although hydrocarbon groups containing other functionality may also be suitable for use herein, even though less desirable. It will be noted that the acidic proton H (hydrogen atom) is usually located on phenolic groups in higher rank coals and on carboxylic groups for lower rank coals. The acidic proton may also be located to a lesser extent on sulfur, nitrogen, etc.

Phase transfer reagents such as quaternary ammonium base ($R_4QOR''$) are very effective in the O-alkylation and O-acylation of coal bottoms. These O-alkylation and O-acylation reactions are successful because the —OR" portion of the molecule is soluble in an organic medium. When this base is present in such a medium, it is not solvated by water or other very polar molecules. As an unsolvated entity, it can react as a very efficient proton transfer reagent. For example $$(\text{Coal})\text{—OH} + \overline{\text{O}}\text{R}'' \rightarrow (\text{Coal})\text{—}\overline{\text{O}} + \text{R}''\text{OH}$$

This unsolvated base (also known as a "naked hydroxide" when R" is hydrogen) can have a wide variety of counter ions. Although the counterion may be a quaternary ammonium or phosphonium species as previously discussed, other examples of counter ions useful in the practice of the invention include "crown ether" complexes of a salt containing the OR" anion and clathrate compounds complexed with a salt containing the OR" anion. Salts represented by MOR", where M is a given above, when complexed with crown ethers, for example, have been previously demonstrated to evidence a reactivity similar to that found for $R_4QOR''$ compounds.

In one embodiment of the process of the invention, a two-phase solid/liquid system comprising the coal bottoms in liquid suspension is formed. The coal bottoms may be ground to a finely divided state and contain particles less than about ¼ inch in size, preferably less than about 8 mesh NBS sieve size, more preferably less than about 8 mesh. The smaller particles, of course, have greater surface area and thus alkylation or acylation will proceed at a faster rate. Consequently, it is desirable to expose as much coal surface area as possible without losing coal bottoms as dust or fines or as the economics of coal grinding may dictate. Thus, particle sizes greater than about 325 mesh are preferred.

Although not necessary, a solvent may be added if desired. The solvent may be used to dissolve alkylated or acylated carbonaceous product or to dissolve alkylating or acylating agent (especially if the agent is a solid and is comparatively insoluble in water). The solvent may also be used to provide for more efficient mixing. Many of the common organic solvents may be employed in any reasonable amount, depending on the desired result.

The phase transfer reagent that is used must dissolve in or be suspended in both phases so that it has intimate contact with both the organic and aqueous phases. During the course of the reaction, the phase transfer reagent will partition itself into both of these phases. Quaternary bases are one class of compounds useful as phase transfer reagents in the practice of the invention and are given by the formula $R_4QOR''$, where R is an alkyl or aryl group having at least one carbon atom, and preferably 1 to 20 carbon atoms, and more preferably 1 to 6 carbon atoms or an aryl group having 6 to 12 carbon atoms, preferably 6 to 12 carbon atoms. The lower number of carbon atoms is preferred, since such compounds are more water soluble and can be removed from the alkylated or acylated coal bottoms by simple water washing. The R groups may be the same or different. Examples of R groups include methyl butyl, phenyl and hexadecyl.

Examples of quaternary bases useful in the practice of the invention include the following:

1. Tetrabutylammonium hydroxide, $(C_4H_9)_4NOH$
2. Benzylhexadecyldimethylammonium hydroxide, $(C_6H_5CH_2)(C_{16}H_{33})(CH_3)_2NOH$
3. Tetrabutylphosphonium hydroxide $(C_4H_9)_4POH$
4. ADOGEN 464, $(C_8\text{–}C_{10})_4NOH$ (ADOGEN 464 is a trademark of Aldrich Chemical Co., Metuchen, N.J.).

The metal base used to convert the quaternary salt to the corresponding base is an alkali metal or alkaline earth metal base such as NaOH, KOH, $Ca(OH)_2$ or $NaOCH_3$. The use of an alkoxide, for example, permits use of the corresponding alcohol in place of water, which may provide an advantage of treating coal bottoms under conditions where water is not desired.

In choosing the alkylating and acylating reagent, two considerations must be weighed. First, it is desired to add longer chains to the coal bottoms which render the product more petroleum-like, and therefore, more soluble in organic solvents and more compatible with petroleum liquids. On the other hand, shorter chains render the alkylated or acylated coal bottoms more volatile. Second, shorter chain materials are also less expensive and still improve solubility.

In the case of O-alkylation, the carbon to which the leaving group is attached may be either a primary or secondary carbon atom. Primary carbon halides have been found to react faster than the corresponding secondary halides in a phase transfer or phase transfer catalyzed reaction on carbonaceous materials and are accordingly preferred. While the balance of the carbon-bearing functional group may, in general, contain other moieties, such as heteroatoms, aryl groups and the like, bonding of the carbon-bearing functional group to the phenolic or carboxylic oxygen is through either an $sp^3$ hybridized carbon atom (alkylation) or an $sp^2$ hybridized carbon atom (acylation). Further, a mixture of alkylating or acylating agents or a mixture of both may advantageously be employed. Such mixtures are likely to be generated in coal-treating plants in other processing steps and thus provide a ready source of alkylating and/or acylating agents. Examples of alkylaing and acylating agents useful in the practice of the invention include ethyl iodide, isopropyl chloride, dimethyl sulfate, benzyl bromide and acetyl chloride.

While alkylating and/or acylating agents are employed in the practice of the invention, alkylating agents are preferred for the following reasons. First, alkylating agents are readily prepared from their hydrocarbon precursors. For example, alkyl halides may be easily prepared by free radical halogenation of alkanes, which is a well-known process. When a system containing more than one alkylating or acylating agent is used, the hydrocarbon precursor is preferably a product stream of a certain cut derived from coal and petroleum processing and the like. This stream may contain minor amounts of components having various degrees of unsaturation which are also suitable for reacting with the phenolic and carboxylic groups herein, as long as X (as previously defined) is attached to an alkyl or saturated carbon atom in the resulting alkylating or acylating reagent. Second, acylating reagents are susceptible to hydrolysis. Since water is present due to the nature of the inventive process, some loss of acylating agent may occur by hydrolysis. In contrast, alkylating reagents do not evidence the same susceptibility to hydrolysis.

If the O-alkylation or O-acylation is carried out by a catalytic process, then the quaternary salt, metal base and alkylating or acylating agent are mixed directly with an aqueous slurry of coal bottoms. The quaternary salt catalyst may be present in small amounts, typically about 0.05 to 10 wt.% of the amount of coal bottoms used; however, greater amounts may also be employed. The metal base and the alkylating or acylating agent must be present in at least stoichiometric quantities relative to the number of acidic sites (phenolic, carboxylic, etc.) on the coal bottoms, but preferably an excess of each is used to drive the reaction to completion. Advantageously, a two-fold excess of metal base and alkylating or acylating agent is employed; however, a greater excess may be employed. After the reaction, the excess quaternary base and quaternary salt catalyst may be removed from the coal bottoms by ample water washing for recycling. Excess metal base will also be extracted into the water wash, and it may be reused. Excess alkylating or acylating agent may be conveniently removed from the treated coal bottoms by fractional distillation or by solvent extraction with pentane or other suitable solvent and may be reused.

To cap off all acidic protons in typical coal bottoms employed in the catalytic process, less than about 2 days are required for 100% conversion, using only a slight excess of alkylating or acylating agent on −80 mesh coal bottoms under atmospheric pressure and ambient temperature. A greater excess of alkylating or acylating agent will reduce the reaction time considerably.

A faster alkylation or acylation reaction may be obtained in a number of ways, one of which is to add the phase transfer reagent ($R_4QOR''$) directly to the coal bottoms rather than to form this reagent in situ with the reaction in which coal bottoms are alkylated or acylated. When this is done, substantially complete conversion of all the phenolic and carboxylic groups is achieved in a matter of minutes. The amount of quaternary base added ranges from about stoichiometric proportions to about 10 times the total number of acidic sites on the coal bottoms which are capable of undergoing alkylation or acylation. As before, the quaternary salt that is generated in the alkylation or acylation step may be recovered and recycled by reacting it with fresh metal base to regenerate the quaternary base. By employing this two-step process, there is no contact between metal base and the coal bottoms, and the reaction is essentially complete in about one hour.

The temperature at which the reaction is carried out may range from ambient to the boiling point of the materials used. Increased temperature will, of course, speed up the reaction rate.

The reaction mixture may be stirred or agitated or mixed in some fashion to increase the interface or surface area between the phases, since there can be aqueous, organic liquid and solid coal bottoms phases present.

The reaction is carried out at ambient pressure, although low to moderate pressures (about 2 to 20 atmospheres) may be employed along with heating to increase the reaction rate.

Once the reagents and solvent if any are removed from the alkylated or acylated coal bottoms, infrared analysis may be conveniently used to determine that all the hydroxyl groups have been alkylated or acylated. If the added alkyl or acyl group is IR-active, then the appearance of the appropriate infrared frequency is observed. Other well-known analytical methods may also be employed if desired. The ultimate analysis of percent C, H, N, S and O is altered in a fashion which is consistent with the expected change due to the added alkyl or aryl substituent. For example, the increase in the H/C ratio of O-methylated coal bottoms from Illinois No. 6 coal indicates that 3.5 methyl groups per 100 carbon atoms are added to the coal bottoms. The H/C ratio in the untreated coal bottoms of Illinois No. 6 coal is 0.754 and the H/C ratio after methylation by the process of the invention is 0.790. The thermogravimetric analysis of the methylated coal bottoms shows a significant increase in volatile organic content over the untreated coal bottoms (48% versus 38%).

Coal bottoms treated in accordance with the invention may be recycled through the liquefaction, gasification, solubilization, etc., processes from which they were derived. Liquid products derived are more compatible with petroleum liquids than those derived from coal bottoms not so treated. The solvent extractability of the coal bottoms is greatly increased after it is O-alkylated or O-acylated. For example, Illinois No. 6 coal bottoms become more soluble in common organic solvents after oxygen-methylation, as shown in Table I below.

TABLE I

| Maximum Solubility (at 1 atm) (DMMF) | Toluene | Tetrahydrofuran |
|---|---|---|
| Illinois #6 Coal Bottoms | 22 | 60 |
| O-methylated Illinois #6 Coal Bottoms | 95 | 95 |

Coal liquids which are derived by solvent extraction of coal bottoms treated in accordance with the invention evidence both improved quality and increased quantity over coal liquids derived from untreated coal.

EXAMPLES

Examples 1–14—Phase Transfer Catalyzed Alkylation

Coal liquefaction bottoms derived from Illinois No. 6 and Wyodak coals are treated employing the reagents and amounts set forth in Table II below. In each case, the reactants were mixed together for 1 to 2 days at ambient temperature.

TABLE II

PHASE TRANSFER CATALYZED REACTIONS

| Example | Coal Liquefaction Bottoms (1) | Solvent | Catalyst (2) | Caustic (3) | R'X (4) |
|---|---|---|---|---|---|
| 1 | CLPP Bottoms-Ill.#6 (−80) | Benzene | B, 20% | NaOH, 50% | $C_2H_5I$, 2920% |
| 2 | CLPP Bottoms-Ill.#6 (−80) | Toluene | B, 10% | NaOH, 50% | $CH_3I$, 3900% |
| 3 | CLPP Bottoms-Ill.#6 (−80) | Toluene | B, 10% | NaOH, 50% | Propargylbromide, 158% |
| 4 | CLPP Bottoms-Ill.#6 (−80) | Toluene | B, 10% | NaOH, 50% | Allylbromide, 526% |
| 5 | CLPP Bottoms-Ill.#6 (−80) | Toluene | B, 10% | NaOH, 50% | $C_7H_{15}I$, 460% |
| 6 | CLPP Bottoms-Ill.#6 (−80) | Toluene | B, 10% | NaOD, 40% | $CD_3I$, 760% |
| 7 | CLPP Bottoms-Ill.#6 (−80) | Toluene | B, 5% | NaOH, 50% | $(CH_3)_2SO_4$, 1200% |
| 8 | CLPP Bottoms-Ill.#6 (−80) | Toluene | B, 10% | NaOH, 50% | $C_{10}H_{21}Br$, 380% |
| 9 | CLPP Bottoms-Ill.#6 (−80) | Toluene | B, 10% | NaOH, 40% | $C_2H_5I$, 731% |
| 10 | CLPP Bottoms-Ill.#6 (−80) | Toluene | T, 5% | NaOH, 12% | $CD_3I$, 100% |
| 11 | CLPP Bottoms-Ill.#6 (−80) | Toluene | T, 5% | NaOH, 12% | $CH_3I$, 250% |
| 12 | U.S. Steel Full Range Tar | Xylenes | A, 4% | NaOH, 20% | $CH_3I$, 314% |
| 13 | CLPP Bottoms-Wyodak | Toluene | T, 5% | NaOH, 12% | $CH_3I$, 330% |
| 14 | CLPP Bottoms-Wyodak | Toluene | T, 5% | NaOH, 12% | $C_4H_9I$, 258% |

Definition of Symbols
(1) Coal origin of bottoms is given; CLPP = Coal Liquefaction Pilot Plant; Mesh size is indicated in parentheses.
(2) B is benzylhexadecyldimethylammonium chloride, A is ADOGEN 464 and T is tetrabutylammonium iodide. Weight percent is relative to carbonaceous material.
(3) Weight percent of metal base in water.
(4) Weight percent relative to coal bottoms.

In the case of CLPP bottoms, 3.5 alkyl groups were added to each 100 carbons in the sample. The H/C ratio of each sample increased in accordance to the chain length of the alkyl group added. The O-alkylated bottoms evidenced greater volatility and solubility in a variety of solvents and were more hydrogen rich and less viscous than the untreated bottoms.

A comparison between untreated coal liquefaction bottoms and O-methylated coal liquefaction bottoms gave the results shown in Table III below.

TABLE III

Comparison Between Untreated and Treated Coal Bottoms

| Property | Coal Liquefaction Bottoms | O-Methylated Coal Liquefaction Bottoms |
|---|---|---|
| Softening point (°C.) | 210 | 120 |
| Apparent viscosity (poise at 232° C.) | 185 | 19.5 |
| Apparent viscosity (poise at 316° C.) | 25 | 1 |
| % Volatile matter | 38 | 48 |
| % Oxidized | 62 | 52 |
| $T_i$ (°C.) | 310 | 250 |
| $T_f$ (°C.) | 600+ | 580 |

Table III shows a dramatic decrease in the softening point and viscosity of coal bottoms, which improve processability. Phase transfer alkylation increases the volatile organic portion of liquefaction bottoms and lowers the boiling range ($T_i$ to $T_f$). Thus, more usable volatile organic coal bottoms are recovered by distillation.

What is claimed is:

1. A method for improving the properties of coal bottoms and products therefrom, by oxygen-alkylation and/or oxygen-acylation, which method comprises contacting the coal bottoms with a solution comprising:

(a) at least one quaternary base represented by the formula $R_4QOR''$ where each R is the same or different group selected from the group consisting of $C_1$ to about $C_{20}$ alkyl and $C_6$ to about $C_{20}$ aryl; Q is nitrogen or phosphorus; and R'' is selected from the group consisting of hydrogen, $C_1$ to about $C_{10}$ alkyl, aryl, alkylaryl, arylalkyl and acetyl; and (b) at least one compound represented by the formula R'X where R' is a $C_1$ to $C_{20}$ alkyl or acyl group and X is selected from the group consisting of halides, sulfates, bisulfates, acetates and stearates; wherein X is attached to a primary or secondary carbon atom.

2. The method of claim 1 wherein R'' is a $C_1$ to $C_4$ alkyl group or hydrogen.

3. The method of claim 2 wherein R'' is hydrogen.

4. The method of claim 1 wherein Q is nitrogen.

5. The method of claim 3 wherein Q is nitrogen.

6. The method of claim 1 wherein each R is the same or different $C_1$ to $C_6$ alkyl group.

7. The method of claim 5 wherein each R is the same or different $C_1$ to $C_6$ alkyl group.

8. The method of claim 1 wherein R' is a $C_1$ to $C_4$ inert hydrocarbon group.

9. The method of claim 7 wherein R' is a $C_1$ to $C_4$ inert hydrocarbon.

10. The method of claim 1 wherein X is selected from the group consisting of chlorine, bromine and iodine.

11. The method of claim 9 wherein X is selected from the group consisting of chlorine, bromine and iodine.

12. The method of claim 11 wherein X is chlorine and R' is a methyl group.

13. The method of claim 1 wherein the amount of quaternary base ranges from about a stoichiometric amount to about 10 times the total number of acidic sites on the coal bottoms.

14. The method of claim 12 wherein the amount of quaternary base ranges from about a stoichiometric amount to about 10 times the total number of acidic sites on the coal bottoms.

15. The method of claim 1 wherein R'X is present in at least a stoichiometric amount relative to the number of acidic sites on the coal bottoms.

16. The method of claim 14 wherein R'X is present in at least stoichiometric amounts relative to the number of acidic sites on the coal bottoms.

17. The method of claim 1 wherein a quaternary salt represented by the formula $R_4QX$ is reacted with an alkali or alkaline earth metal base represented by the formula MOR" to form the corresponding quaternary base, wherein M is an alkali or alkaline earth metal.

18. The method of claim 16 wherein a quaternary salt represented by the formula $R_4OX$ is reacted with an alkali or alkaline earth metal base represented by the formula MOR" to form the corresponding quaternary base, wherein M is an alkali or alkaline earth metal.

19. The method of claim 17 wherein the reaction is carried out catalytically.

20. The method of claim 19 wherein the amount of quaternary salt is a catalytic amount ranging from about 0.05 to 10 wt.% of the coal bottoms.

21. The method of claim 17 wherein the quaternary base is formed separate from the alkylation or acylation reaction.

22. The method of claim 17 which is repeated at least once.

* * * * *